United States Patent [19]

Hara

[11] Patent Number: 4,531,652

[45] Date of Patent: Jul. 30, 1985

[54] BUCKET FOR USE IN CENTRIFUGAL SEPARATORS

[75] Inventor: Minoru Hara, Sakado, Japan

[73] Assignee: Kabushiki Kaisha Kubota Seisakusho, Tokyo, Japan

[21] Appl. No.: 624,168

[22] Filed: Jun. 25, 1984

[51] Int. Cl.[3] ..... B04B 9/12

[52] U.S. Cl. ..... 220/83; 494/20

[58] Field of Search ..... 220/83, 85 H, 91, 92; 215/100 A; 494/20

[56] References Cited

U.S. PATENT DOCUMENTS

| | | | |
|---|---|---|---|
| 3,722,791 | 3/1973 | Wright | 494/20 |
| 4,030,663 | 6/1977 | Conn et al. | 494/20 |
| 4,148,433 | 4/1979 | Bayley | 494/20 |
| 4,342,419 | 8/1982 | Conway | 494/20 X |
| 4,439,177 | 3/1984 | Conway | 494/20 |

*Primary Examiner*—Steven M. Pollard

*Attorney, Agent, or Firm*—Pollock, Vande Sande and Priddy

[57] ABSTRACT

A bucket, for use on a swing-type rotor in a centrifugal separator, shaped to receive specimen holders of several different configurations. The bucket has a pair of diametrically opposite side walls having central portions displaced radially outwardly as first and second arcuate wall portions extending around a central axis of the bucket and another pair of diametrically opposite side walls having upper portions displaced radially outwardly as inverted U-shaped bearings for allowing the bucket to be suspended on the rotor. The other side walls are spaced from each other by a distance equal to or greater than the diameter of the arcuate wall portions.

7 Claims, 9 Drawing Figures

BUCKET FOR USE IN CENTRIFUGAL SEPARATORS

BACKGROUND OF THE INVENTION

The present invention relates to a bucket for holding specimens in a centrifugal separator while the specimens are subjected to centrifugal separation, and more particularly to such a bucket for use with a swing-type rotor.

For centrifugal separation of specimens, the specimens are placed in test tubes held by one holder which is housed in a bucket. The bucket is swingably suspended from a swing-type rotor that will be rotated at high speed for separating the specimens under centrifugal forces. When a relatively large quantity of specimens are to be separated, they are put in a specimen bottle directly accommodated in the bucket. The bucket is also swingably suspended from the swing-type rotor that will be rotated at high speed for separating the specimens under centrifugal forces.

The holder for holding test tubes has a rectangular-parallelepiped shape or a cylindrical shape, and the specimen bottle has a tubular shape or a hollow rectangular parallelepiped shape. The bucket is required to hold the holder or the specimen bottle stably so that the test tubes or the specimen bottle will not be broken and the separated specimens will not be disturbed. To meet such a requirement, a bucket for accommodating a rectangular-parallelepiped-shaped holder or a hollow rectangular-parallelepiped-shaped specimen bottle therein has heretofore been complementarily box shaped so that the holder or the specimen bottle will snugly fit in the bucket. Similarly, a bucket for accommodating a cylindrical holder or a hollow cylindrical or tubular specimen bottle therein has heretofore been complementarily cylindrical in shape so that the holder or the specimen bottle will snugly fit in the bucket. The cylindrical bucket is disclosed in U.S. Pat. Nos. 4,009,824 and 4,032.066, and the box-shaped bucket is shown in U.S. Pat. Nos. 4,141,489 and 4,147,494. Therefore, it has been customary practice to have two kinds of buckets, box-shaped and cylindrically shaped, in readiness for use, and to change the buckets, if necessary, to meet the shape of a holder or specimen bottle to be used, a procedure which has been tedious and time-consuming.

The bucket has heretofore been fabricated by cutting a heat-treated and forged block of aluminum. More specifically, the fabrication process has included the steps of preparing a bucket in the form of an aluminum casting, partly cutting the bucket, heat-treating the bucket to increase its mechanical strength, and treating the surface of the bucket to enhance corrosion resistance. The bucket is therefore expensive to manufacture, and a plurality of such expensive buckets have been required by one centrifugal, as described above. Where a bucket comprises a casting, it tends to have internal defects that are difficult to detect in advance. If any defective bucket is used, the centrifugal separator suffers from the danger of getting broken during operation.

SUMMARY OF THE INVENTION

It is an object of the present invention to provide a bucket for use in a centrifugal separator, which can be used with a rectangular-parallelepiped-shaped holder, a hollow rectangular-parallelepiped-shaped holder, a cylindrical holder, or a hollow cylindrical or tubular specimen bottle.

Another object of the present invention is to provide a bucket for use in a centrifugal separator, which can be mass-produced and is inexpensive to manufacture.

A bucket according to the present invention is substantially in the form of a hollow rectangular-parallelepiped-shaped body. The bucket includes a pair of diametrically opposite side walls having central portions displaced radially outwardly as arcuate wall portions constituting part of a cylindrical surface and extending around a common vertical axis that is substantially equal to a central axis of the bucket. The bucket also has another pair of diametrically opposite side walls having upper portions displaced radially outwardly as inverted U-shaped bearings recessed in outer surfaces of the side walls. The bucket is swingably suspended on a swing-type rotor with supporting projections on support arms of the rotor being inserted respectively in the bearings. The opposite side walls are spaced by a distance slightly greater than that between opposite outer surfaces of a rectangular-parallelepiped-shaped holder or a box-shaped specimen bottle to be held in the bucket, and the arcuate wall portions have a diameter slightly larger than an outside diameter of a cylindrical holder or a hollow cylindrical or tubular specimen bottle. The arcuate wall portions and the side walls defining them have upper edges displaced slightly radially outwardly as reinforcing edges, and a bottom plate integral with the opposite side walls has at least one reinforcing rib displaced downwardly.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
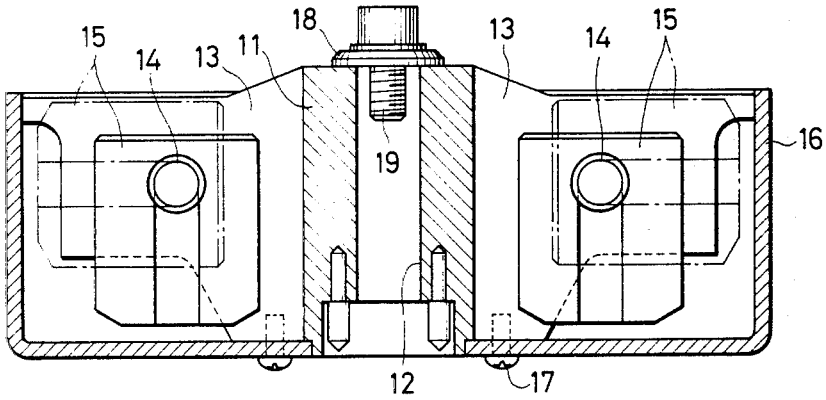
FIG. 1 PRIOR ART
FIG. 1 is a cross-sectional view of a swing-type rotor for use in a centrifugal separator.

A swing-type rotor on which buckets of the present invention will be mounted will first be described with reference to FIG. 1.

The swing-type rotor includes a rotor body 11 having a central through hole 12 defined therein for passage of a rotatable shaft therethrough, and a plurality of integral support arms 13 extending radially from the rotor body 11 and angularly spaced at equal angular intervals around the rotor body 11. Supporting projections 14 project in confronting relation from adjacent ones of the support arms 13. A bucket 15 is swingably suspended from and between each pair of the confronting supporting projections 14, and holds e.g. test tubes (not shown) with specimens placed therein. In the arrangement shown in FIG. 1, the entire rotor, including all of the buckets 15, is accommodated in a cover 16 having a bottom plate fastened by screws 17 to the rotor body 11. Although not shown, the rotatable shaft is inserted from below into the through hole 12, and the rotor body 11 is fixed to the inserted rotatable shaft by a screw 19 threaded into the shaft with a washer 18 therebetween. When the rotatable shaft is rotated, the rotor is rotated therewith to cause the buckets 15 to swing upwardly through approximately 90° about the supporting projections 14, as indicated by the dot-and-dash lines, under centrifugal forces.

In use, a single relatively large, tubular specimen bottle is inserted in one bucket, or a plurality of test tubes are inserted in one bucket. It has been conventional practice to use a tubular bucket for holding the tubular specimen bottle, and a box-shaped bucket for holding the test tubes.

Figure 2:
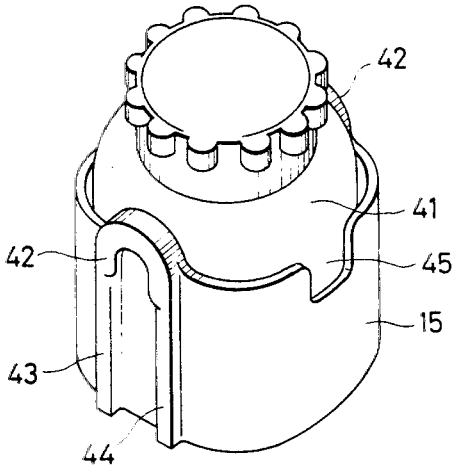
FIG. 2 PRIOR ART
FIG. 2 is a perspective view of a conventional bucket with a cylindrical specimen bottle accommodated therein.

More specifically, FIG. 2 illustrates a conventional tubular bucket 15 accommodating a tubular specimen bottle 41 fitted snugly therein. The bucket 15 has a pair of semicircular bearings 42, 42 disposed in diametrically opposite relation across a central axis of the bucket 15 and projecting from an upper edge thereof. Each of the bearings 42, 42 has lower ends contiguous to a pair of parallel ridges 43, 44 disposed on an outer peripheral surface of the bucket 15 and extending to a bottom thereof. The bucket 15 is suspended by the bearings 42 on the supporting projections 14 of the rotor. The cylindrical bucket 15 has in its upper peripheral edge a pair of diametrically opposite recesses 45 (only one shown) positioned between the bearings 42, 42. When the tubular specimen bottle 41 is to be removed from the tubular bucket 15, the specimen bottle 41 can be gripped by fingers placed in the recesses 45 and lifted out of the bucket 15 without disturbing the specimen contained in the specimen bottle 41.

Figure 3:
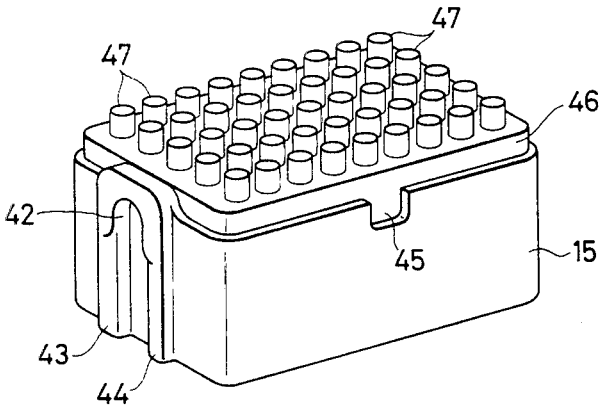
FIG. 3 PRIOR ART
FIG. 3 is a perspective view of a conventional bucket with a rectangular-parallelepiped-shaped holder accommodated therein.

FIG. 3 illustrates a conventional bucket 15 holding a plurality of test tubes. A holder 46 substantially in the form of a rectangular parallelepiped has a matrix of vertical holes therein opening into an upper surface of the holder 46. The test tubes 47 are inserted respectively into the holes. The rectangular-parallelepiped-shaped holder 46 is accommodated in the bucket 15 which is of a hollow, substantially rectangular-parallelepiped-shape. The bucket 15 has a pair of bearings 42 (only one shown).

Accordingly, it has conventionally been required to provide two differently shaped buckets, i.e., tubular and box-shaped buckets respectively, for the tubular specimen bottle and the rectangular-parallelepiped-shaped holder. These prior buckets are, moreover, prepared by cutting forged blocks of aluminum and hence are expensive to manufacture.

FIGS. 4 through 7 show a bucket for a centrifugal separator, according to the present invention, which is adapted to perform the functions of the two differently shaped buckets of the prior art. The bucket of the present invention has side walls jointly providing a hollow, substantially rectangular parallelepiped configuration and including a pair of confronting side walls 20, 21 having flat end portions and circumferentially intermediate portions that project radially outwardly as arcuate wall portions 22, 23 confronting each other. The arcuate wall portions 22, 23 are preferably part of a common cylindrical surface extending around the central axis of the bucket 15, and conform to the shape of the periphery of the tubular specimen bottle 41 (FIG. 2) to be placed in the bucket 15. The bucket 15 also has another pair of confronting side walls 24, 25 which are flat. In the illustrated embodiment, the confronting side walls 24, 25 are spaced from each other by a distance $D_1$, and the cylindrical surface, which the arcuate wall portions 22, 23 are part of, has a diameter $R_1$ that is substantially equal to the distance $D_1$.

The opposite side walls 24, 25 have upper portions pressed outwardly away from each other in the form of an inverted U shape. More specifically, the side wall 24 has upper spaced side portions and an upper intermediate marginal portion which are pressed outwardly to provide spaced recesses **24*a*, 24*b* and an upper intermediate recess 24*c* connecting both the spaced recesses. Likewise, the side wall 25 has upper spaced side portions and an upper intermediate marginal portion which are pressed outwardly to provide spaced recesses 25*a*, 25*b* and an upper intermediate recess 25*c*. The outwardly pressed portions of the inverted U shape of the opposite side walls 24, 25 provide a pair of bearings 26, 27 on outer peripheral surfaces of the bucket 15, in which bearings the supporting projections 14 (FIG. 1) will be inserted. The bearings 26, 27 have semicircular upper portions having upwardly convex surfaces. The flat portions of side walls 20, 21 are spaced from each other by a distance $D_2$. The distances $D_1$, $D_2$ are selected such that the rectangular-parallelepiped-shaped holder 46 (FIG. 3) will substantially fit in the bucket 15**.

The side walls 20, 21 and their arcuate wall portions 22, 23 have upper marginal edges pressed slightly outwardly as arcuate reinforcing marginal edges 28, 29 including central outer locking recesses 31, 32 for allowing a cover (not shown) covering an upper opening of the bucket 15 to engage therein so that the cover is securely locked on the bucket 15. The bucket 15 also includes a bottom plate 33 having two parallel ribs 34, 35 pressed downwardly therefrom.

Figure 4:
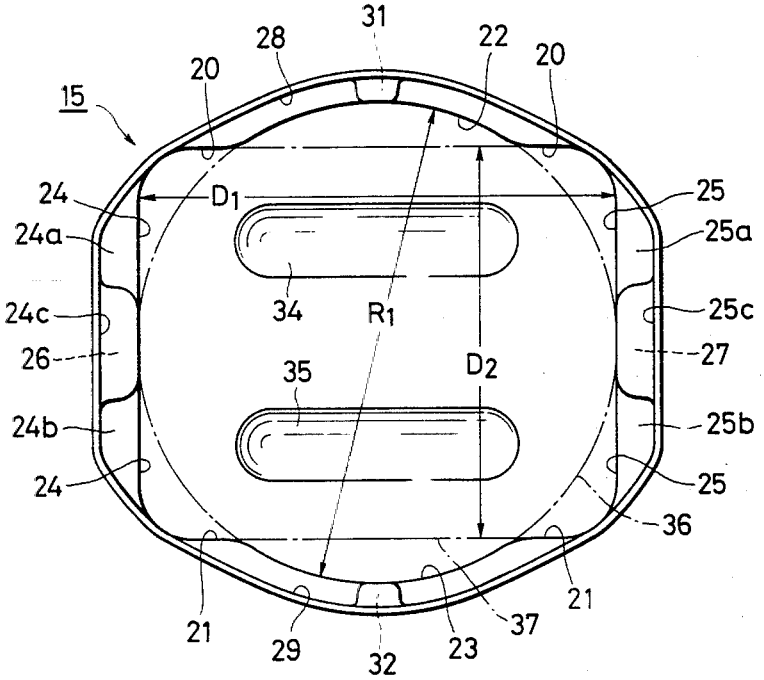
FIG. 4 is a plan view of a bucket according to the present invention.
Figure 5:
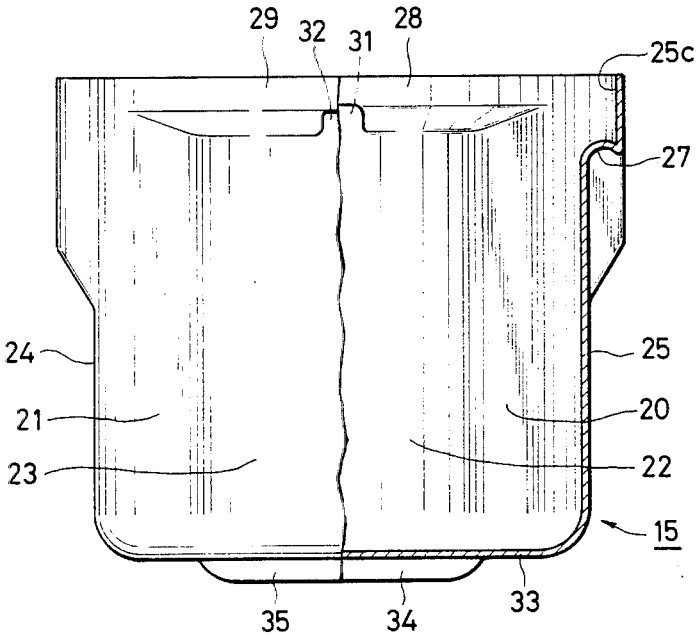
FIG. 5 is a front elevational view, with a righthand half shown in cross section, of the bucket of FIG. 4.
Figure 6:
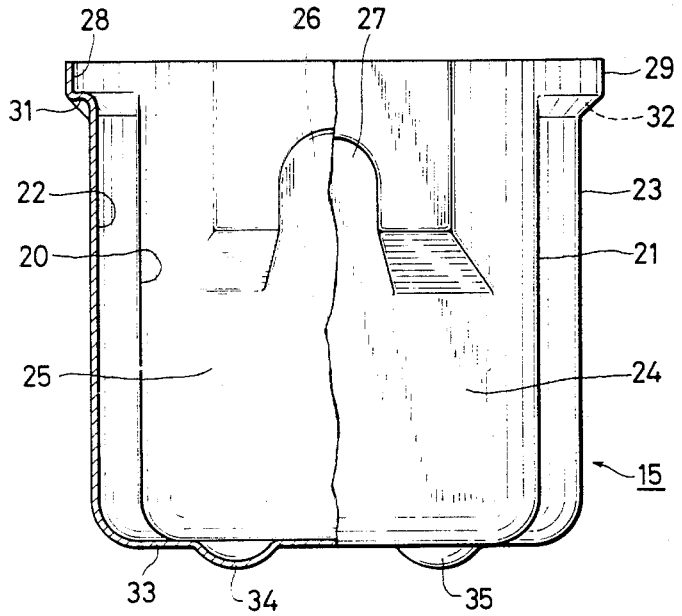
FIG. 6 is a righthand side elevational view, with a front half shown in cross section, of the bucket of FIG. 4.
Figure 7:
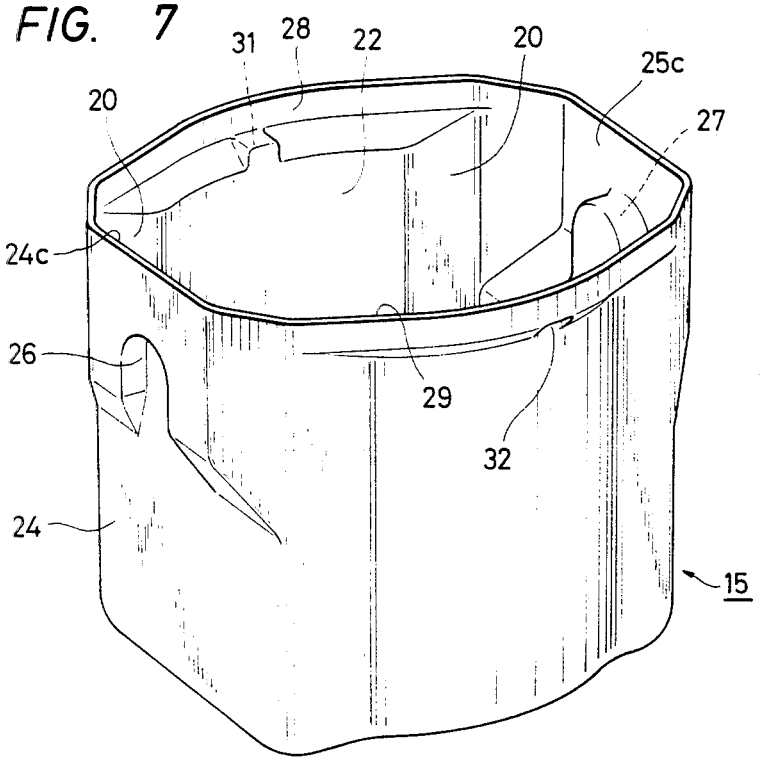
FIG. 7 is a perspective view of the bucket of FIG. 4.
Figure 8:
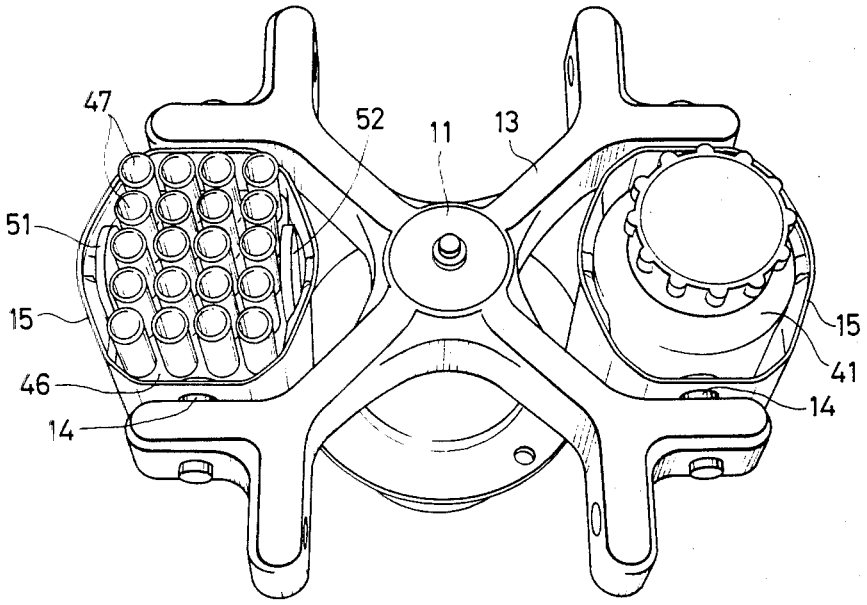
FIG. 8 is a perspective view of buckets of the invention which support a tubular specimen bottle and a rectangular-parallelepiped-shaped holder respectively therein and which are suspended from a swing-type rotor.

When the tubular specimen bottle 41 (FIG. 2) is placed in the bucket 15 of the invention as shown in FIG. 8, the outer peripheral surface of the specimen bottle 41 is positioned closely to the inner peripheral surfaces of the arcuate wall portions 22, 23 and also to the inner surfaces of the side walls 24, 25 as indicated by the dot-and-dash line 36 in FIG. 4, with the result that the specimen bottle 41 is substantially fitted in the bucket 15.

Figure 9:
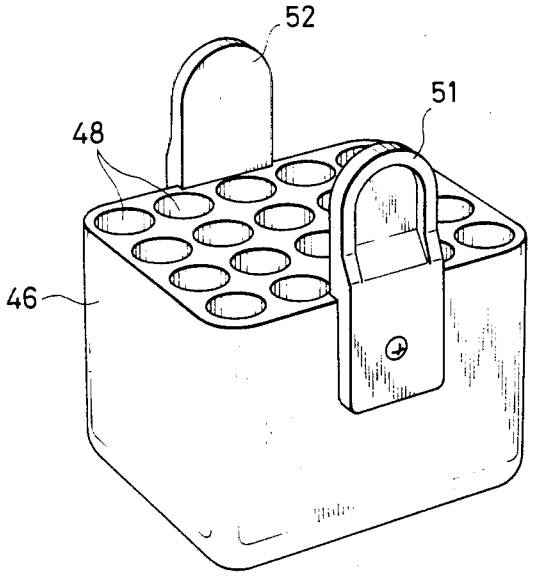
FIG. 9 is a perspective view of a rectangular-parallelepiped-shaped holder.

When test tubes are to be supported in the bucket 15, using a rectangular holder, the test tubes 47 are inserted in holes 48 defined in the rectangular holder 46 which is substantially of a rectangular parallelepiped form as shown in FIG. 9 and is made of a transparent synthetic resin material, and the holder 46 is placed in the bucket 15 as illustrated in FIG. 8. At this time, the outer peripheral surface of the holder 46 is positioned closely to the inner flat surfaces of the side walls 20, 21, 24, 25 as indicated by the dot-and-dash line 37 in FIG. 4, with the result that the holder 46 is substantially fitted in the bucket 15. The rectangular-parallelepiped-shaped holder 46 has a pair of handles 51, 52 which will be placed respectively in spaces defined by the arcuate wall portions 22, 24, and hence will not interfere with the bucket 15.

The bucket 15 of the present invention can support either the tubular specimen bottle 41 or the rectangular-parallelepiped-shaped holder 46 in substantially interfitting relation thereto. With the bottle 41 or the holder 46 held in the bucket 15, the bearings 26, 27 are placed on the supporting projections 14 of the rotor as shown in FIG. 8 to swingably support the bucket 15 on the rotor. Test tubes may be inserted into holes defined in a cylindrical holder (not shown) having an outer peripheral surface similar to that of the tubular specimen bottle 41, and such a cylindrical holder may be placed in the bucket 15 of the invention. Furthermore, a box-shaped specimen bottle similar in outer peripheral surface to the rectangular-parallelepiped-shaped holder 46 may be placed in the bucket 15.

The bucket of the present invention can therefore support therein any of the cylindrical holder, the hollow cylindrical or tubular specimen bottle, the rectangular-parallelepiped-shaped holder, and the box-shaped specimen bottle, and for this reason there is no need for different types of buckets to be provided in readiness for use. It is not necessary to change the buckets depending on whether specimens are to be placed in test tubes for centrifugal separation or whether a specimen is to be placed in a tubular specimen bottle. Accordingly, the procedure followed in preparation for centrifugal separation can be simplified.

Since the cylindrical or rectangular-parallelepiped holder or the box-shaped or tubular specimen holder is held in substantially close contact with the arcuate surfaces or flat surfaces of the side walls of the bucket 15, the holder and the specimen bottle will be stably held in place when rotating or stopping the rotor, and particularly separated specimens will not be disturbed.

The arcuate wall portions 22, 23 are formed as ribs on the side walls 20, 21 to give the side walls 20, 21 an increased mechanical strength against bending forces imposed thereon in a direction normal to the axis of the bucket 15. Likewise, the inverted U-shaped pressed portions defining the bearings 26, 27 give the side walls 24, 25 an increased mechanical strength against bending forces applied thereto in a direction normal to the axis of the bucket 15. The mechanical strength of the bucket 15 is also increased by the reinforcing marginal edges 28, 29 and the ribs 34, 35 on the bottom plate.

The bucket of the invention can be manufactured simply by pressing a sheet of stainless steel, for example, and hence can be mass-produced inexpensively. The pressed bucket can have a small wall thickness but can nevertheless withstand strong centrifugal forces applied thereto. For example, a bucket having the shape as specified in the foregoing embodiment was prepared by pressing a sheet of SUS 304 having a thickness of 2.0 mm, the bucket having the following dimensions: $R_1=99$ mm, $D_1=101$ mm, $D_2=81$ mm, and the depth=100 mm. The bucket was able to withstand a centrifugal force produced when it was rotated at 3,100 r.p.m. while carrying a content weighing 1.4 Kg, the centrifugal force applied to the specimens being 2,000 G at maximum.

The arcuate wall portions 22, 23 serve to accommodate the handles 51, 52 when the rectangular-parallelepiped-shaped holder 46 is placed in the bucket 15. The distance $D_1$ between the side walls 24, 25 may be greater than the diameter $R_1$, and suitable spacers may be inserted between the side walls 24, 25 and the cylindrical holder or the tubular specimen bottle placed in the bucket 15.

Although a certain preferred embodiment has been shown and described, it should be understood that many changes and modifications may be made therein without departing from the scope of the appended claims.

What is claimed is:

1. A bucket for suspension from a swing-type rotor in a centrifugal separator, comprising:

(a) first, second, third and fourth integrally joined, successive side walls jointly providing a hollow rectangular-parallelepiped-shaped body, and a bottom plate integrally joined to the lower edges of said first through fourth side walls;

(b) said first and third side walls having substantially flat end portions which are disposed in diametrically opposite relation to each other and having circumferentially central portions which are displaced radially outwardly from said substantially flat end portions to form a pair of arcuate wall portions on said first and third side walls respectively which arcuate wall portions are parts of a cylindrical surface extending substantially around a central axis of the bucket;

(c) said second and fourth side walls being substantially flat and being disposed in diametrically opposite relation to each other, the upper portions of said second and fourth side walls being displaced radially outwardly in an inverted U-shape to form first and second bearings having recesses in the outer surfaces of said second and fourth side walls shaped to allow the bucket to be swingably suspended on the rotor; and (d) said second and fourth side walls being spaced from each other by a distance that is at least equal to the diameter of said cylindrical surface.

2. A bucket according to claim 1, wherein said first and third side walls have upper edges expanded radially outwardly beyond said arcuate wall portions to form first and second arcuate reinforcing edges.

3. A bucket according to claim 2, wherein said first and second reinforcing edges have intermediate portions that are displaced radially inwardly and have first and second small-size engaging recesses respectively in the outer surfaces thereof.

4. A bucket according to claim 2, wherein said bottom plate has a pair of downwardly displaced reinforcing ribs.

5. A bucket according to claim 1, wherein said distance between said second and fourth side walls is greater than said diameter of said cylindrical surface.

6. A bucket according to claim 1, wherein said bottom plate has at least one downwardly displaced reinforcing rib.

7. A bucket according to claim 1, wherein said bucket is fabricated of metal sheet material.

* * * * *